US006520483B1

(12) United States Patent
Miyoshi et al.

(10) Patent No.: US 6,520,483 B1
(45) Date of Patent: Feb. 18, 2003

(54) HOISTING DEVICE FOR AN ELEVATOR

(75) Inventors: Hiroyuki Miyoshi, Mie (JP); Takashi Kuga, Mie (JP)

(73) Assignee: Teijin Seiko Co., Ltd., Tokyo (JP)

( * ) Notice: Subject to any disclaimer, the term of this patent is extended or adjusted under 35 U.S.C. 154(b) by 0 days.

(21) Appl. No.: 09/604,173

(22) Filed: Jun. 27, 2000

(30) Foreign Application Priority Data

Jul. 2, 1999 (JP) ..... 11-188538
Apr. 4, 2000 (JP) ..... 2000-102725

(51) Int. Cl.[7] ..... B66D 1/48
(52) U.S. Cl. ..... 254/267; 254/342
(58) Field of Search ..... 254/267, 275, 254/342, 344, 356, 362, 365, 375, 391

(56) References Cited

U.S. PATENT DOCUMENTS 2,594,484 A * 4/1952 Nixon ..... 254/267
2,896,912 A * 7/1959 Faugier et al. ..... 254/267
4,118,013 A * 10/1978 Christison et al. ..... 254/344
4,328,954 A * 5/1982 Logus ..... 254/344
4,332,372 A * 6/1982 Singer ..... 254/391
4,582,179 A * 4/1986 Nelson ..... 254/267
4,854,547 A * 8/1989 Oliphant ..... 254/344
5,127,631 A * 7/1992 Flaig ..... 254/267
5,860,635 A * 1/1999 Morfitt et al. ..... 254/344
5,927,692 A * 7/1999 Huggett et al. ..... 254/342
6,042,086 A * 3/2000 Roberts ..... 254/342
6,126,143 A * 10/2000 Fukunaga et al. ..... 254/344
6,223,868 B1 * 5/2001 Wullimann ..... 254/267

FOREIGN PATENT DOCUMENTS

| | | |
|---|---|---|
| EP | 0 841 283 A1 | 5/1998 |
| JP | A-63-12144 | 4/1988 |
| JP | 07133849 | 5/1995 |
| JP | 08226498 | 9/1996 |
| JP | 10252638 | 9/1998 |

* cited by examiner

*Primary Examiner*—Emmanuel Marcelo
(74) *Attorney, Agent, or Firm*—Akin, Gump, Strauss, Hauer & Feld, L.L.P.

(57) ABSTRACT

In a hoisting device for an elevator, a driving motor is made cylindrical, and a brake system is accommodated radially inwardly of the driving motor. The driving motor and the brake system overlap in a radial direction.

7 Claims, 3 Drawing Sheets

HOISTING DEVICE FOR AN ELEVATOR

BACKGROUND OF THE INVENTION

The present invention relates to a hoisting device for an elevator that lift up and down a moving cage by moving a main rope connected to the moving cage.

A hoisting device for an elevator is disclosed in JP-A-63-12144. This hoisting device comprises a driving motor, a brake means mounted on one side of the driving motor for imparting a braking force to a rotating shaft of the driving motor, and a speed reducer mounted on the other side of the driving motor for reducing the rotational speed of the driving motor to output to a sheave.

The elevator hoisting device of this type, however, suffers from a problem that the axial length of the device is large since the brake means, driving motor and speed reducer are arranged linearly or in series in an axial direction.

SUMMARY OF THE INVENTION

The present invention was made in view of the above problem and an object thereof is to provide a thin hoisting device for an elevator, the axial length of which is small.

To achieve the above-noted object, the present invention provides an arrangement for an elevator hoisting device, in which a driving motor is made cylindrical, and a brake system is accommodated radially inwardly of the driving motor.

A hoisting device for an elevator according to a preferred embodiment includes a cylindrical driving motor, a brake system accommodated radially inwardly of the driving motor for applying a braking force relative to a rotary portion of the driving motor and a speed reducer, disposed on one side of the driving motor and the brake system in a tightly contacting manner, for reducing and outputting the rotational speed of the motor to a sheave.

In this invention, since the driving motor is made cylindrical and the brake system is accommodated radially inwardly of the driving motor, the driving motor and the brake means overlap in the radial direction. This make the axial length of the hoisting device short by a length corresponding to the axial length of the brake system. Accordingly, the hoisting device can be thinned to that extent.

It is preferable that the brake system is formed into a cylindrical shape, and a detector for detecting rotational speed of the sheave is disposed radially inwardly of the brake system. This can prevent the axial length of the hoisting device from being increased even if a detector is additionally mounted.

It is also preferable that the brake system includes: an annular stationary member, a shoe radially movably supported on the stationary member, and a press portion for imparting a radially outward biasing force to the shoe, and the shoe is adapted to be pressed against an inner circumferential surface of the rotary portion of said driving motor. In a case where a shoe is constructed so as to be pressed against an inner circumferential surface of the rotary portion of the driving motor, the rotary portion of driving motor and a brake drum can be shared. Accordingly, the hoisting device can be made simple in construction and compact in size.

In a case where the internal gear of the reduction gear and the sheave are made integral with each other, the attachment of the sheave to the internal gear is no more needed, and the construction can be simplified.

In a case where seal members are provided between the input shaft and the carrier and between the carrier and the internal gear to sealingly close an interior of said speed reducer, there is no more need to dispose separate seal members between the relevant portions when the brake system and the speed reducer are assembled to the driving motor.

Moreover, in a case where a hoisting device for an elevator is constructed by a driving motor, and a brake system having therein two brake operating portions, the brake force is doubled to thereby improve the safety, and since two brake operating portions are provided in a single brake device, the hoisting device can be miniaturized.

The present disclosure relates to the subject matter contained in Japanese patent application No. Hei. 11-188538 (filed on Jul. 2, 1999) and 2000-102725 (filed on Apr. 4, 2000), which are expressly incorporated herein by reference in their entireties.

DESCRIPTION OF THE PREFERRED EMBODIMENT

A first embodiment of the invention will be described below with reference to the accompanying drawings.

Figure 1:
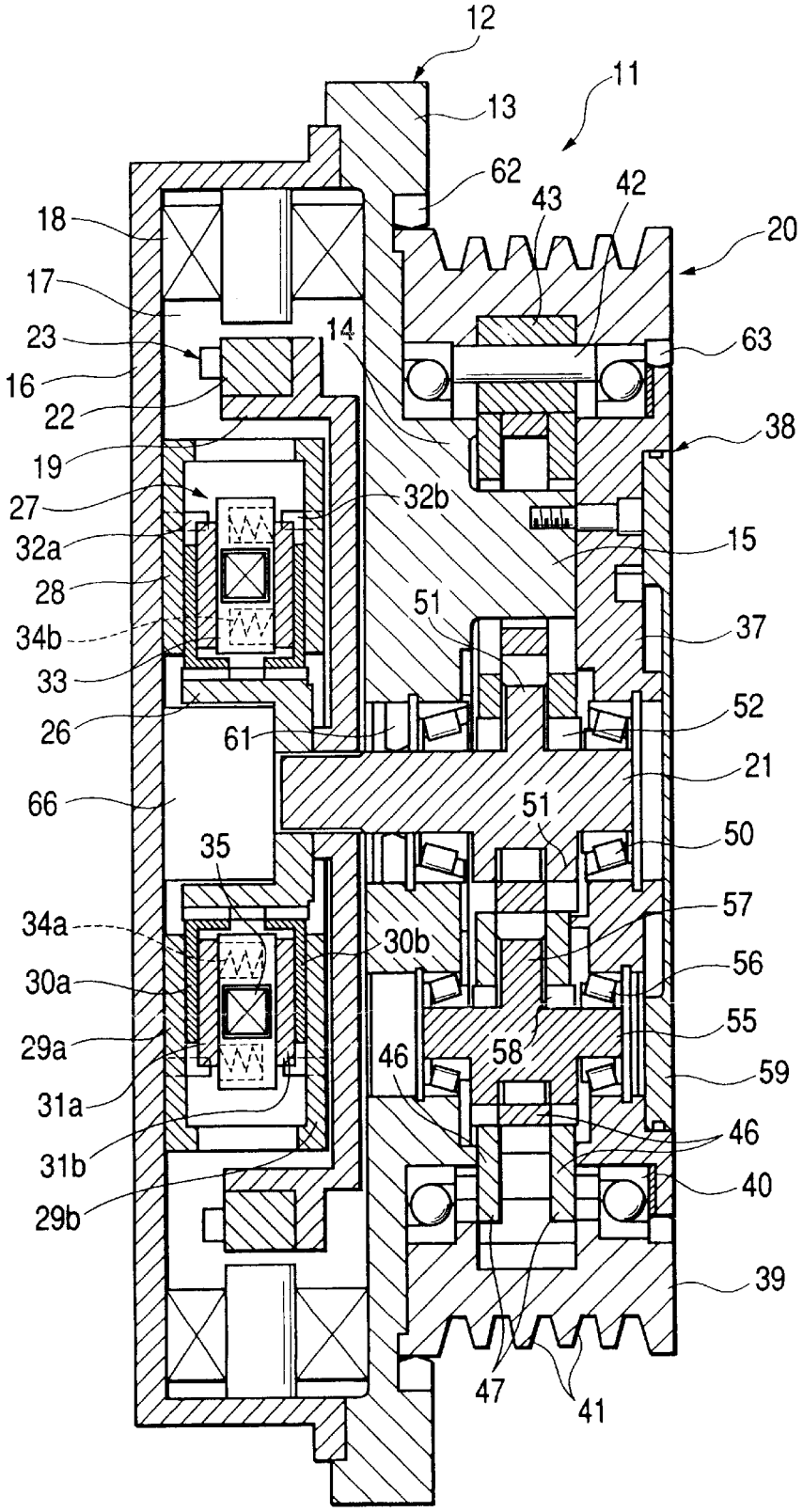
FIG. 1 is a front cross-sectional view showing a first embodiment of the invention.

In FIG. 1, reference numeral 11 denotes a hoisting device for an elevator, and this hoisting device has a stationary member 12 fixed to a stationary frame, not shown. This stationary member 12 has a large diameter portion 13 formed into a large diameter disc-like shape, a small diameter portion 14 formed into a small diameter disc-like shape which is made contiguous to one side of the large diameter portion 13 and a plurality of pillar portions 15 protruding from one side of the small diameter portion 14 in a direction opposite from the large diameter portion 13. The other side or end face of the large diameter portion 13 is formed almost entirely as a flat plane with the exception of the radially outer end portion thereof.

Reference numeral 16 denotes a cylindrical case having a bottom (i.e. a cup-shaped case). An open end (one end) of the case 16 is fixed to the other side (i.e. the end face) of the large diameter portion 13 to define a closed space 17 between the case 16 and the large diameter portion 13. Reference numeral 18 denotes a cylindrical coil fixed to a radially outer end portion of the case 16, and a substantially disc-like rotary body 19 is provided radially inwardly of the coil 18. An end portion (i.e., a left end portion in FIG. 1) of an input shaft 21 of an eccentric oscillating type speed reducer 20 is spline-connected to a radially inner end of the rotary body 19, whereas a plurality of permanent magnets 22 are disposed along the coil 18 and fixed to a radially outer end of the rotary body 19. When the coil 18 is excited, the permanent magnets 22 rotate about an axis, and this rotation is transferred through the rotary body 19 to the input shaft 21 to drive the input shaft 21. The coil 18 and the permanent magnets 22 cooperatively constitute a cylindrical driving motor 23, an electric motor in this embodiment.

Reference numeral 26 denotes a substantially cylindrical intermediate member that is spline-connected to the left end of the input shaft 21. A brake system 27 is accommodated between the intermediate member 26 and the driving motor 23, or radially inwardly of the driving motor 23 to apply a braking force to the permanent magnets 22 which is a rotary portion of the driving motor 23. In a case where the driving motor 23 is made cylindrical like this with the brake system 27 being accommodated radially inwardly of the driving motor 23, these driving motor 23 and brake system 27 overlap in the radial direction, whereby the hoisting device 11 can be reduced in length in the axial direction by a length corresponding to the axial length of the brake system 27, the hoisting device 11 being thereby thinned to that extent.

The brake system 27 comprises a single brake device and has a stationary member 28 fixed to the case 16, the stationary member 28 having a pair of axially spaced away stationary walls 29*a, b*. Reference numerals 30*a, b* are braking plates disposed between the stationary walls 29*a, b* and making a pair, in this case, a pair of ring-like braking plates, and radially inner ends of the braking plates 30*a, b* are spline-connected to the outer circumference of the intermediate member 26. As a result of this, these braking plates 30*a, b* can move axially between the stationary walls 29*a, b,* and are connected to the permanent magnets 22 of the driving motor 23 via the intermediate member 26, the input shaft 21 and the rotary body 19 so as to rotate together.

Reference numerals 31*a, b* denote a pair of armatures disposed between the braking plates 30*a, b* in such a manner as to move axially, and these armatures 31*a, b* are regulated with respect to their movement in a radial direction when pins 32*a, b* fixed, respectively, to the stationary walls 29*a, b* are inserted into. a plurality of semi-circular recesses formed in the radially outer end thereof. Reference numeral 33 denotes a receiving member disposed between the armatures 31*a, b* and fixed to the stationary member 28, and a plurality of springs 34*a, b* are accommodated in the receiving member 33, the plurality of springs being adapted, respectively, to press the braking plate 30a against the stationary wall 29*a* via the armature 31*a,* and the braking plate 30*b* against the stationary wall 29*b* via the armature 31*b*.

When the braking plates 30*a, b* are pressed against by the biasing force of the springs 34*a, b* disposed between the braking plates 30*a, b* via the armatures 31*a, b,* the rotation of the braking plates 30*a, b* is restricted by virtue of frictional resistance with the stationary walls 29*a, b,* and a braking force is applied to the permanent magnets 22 of the driving motor 23. In a case where two brake operating portion having the braking plates 30*a, b* constructed so as to operate as described above are constructed to be pressed against, respectively, the pair of stationary walls 29*a, b* to thereby apply a braking force, since brakes are to be applied simultaneously at two portions of the driving motor 23, the braking force applied becomes double, and even if one of the two fails to function, the other still can apply the brake force, whereby the safety can be improved. Thus, since the brake system 27 (the single brake device) incorporates two brake operating portion, in other words, since two mechanical operating portions operate independently in response to a single electric signal, not only can the safety be improved but also the hoisting device can be miniaturized.

Reference numeral 35 denotes an annular electromagnet which is disposed between the braking plates 30*a, b* when it is received in the receiving member 33. The electromagnet 35, when excited, attracts the armatures 31*a, b* in such a manner that they move toward each other. Then, when the armatures 31*a, b* move toward each other, since the springs 34*a, b* are contracted by being pressed by the armatures 31*a, b,* the braking plates 30*a, b* are released from the pressing force of the spring 34*a, b,* and the driving motor 23 is released from the brake applied thereof. The aforesaid stationary member 28, braking plates 30*a, b,* armatures 31*a, b,* receiving member 33, springs 34*a, b* and electromagnet 35 cooperatively constitute the disc-type cylindrical brake system 27.

The aforesaid speed reducer 20 is disposed on and adjacent to the one side of the driving motor 23 and the brake system 27, and this speed reducer 20 has a ring-like end plate 37 fixed to one side of the pillar portions 15. The aforesaid stationary member 12 and this end plate 37 cooperatively constitute a carrier 38. This carrier 38 is supported such that only the stationary member 12 is fixed to the stationary frame (i.e. one axial end of the carrier 12 is supported, but the other axial end thereof is free), and therefore the hoisting device 11 can be miniaturized. Reference 39 denotes a rotatable cylindrical internal gear is disposed radially outwardly of and surrounds the small diameter portion 14, the pillar portions 15 and the end plate 37, and this internal gear 39 is rotatably supported on the carrier 38 via a pair of bearings 40 each disposed at a respective axial end portion of the internal gear 39 and interposed between an inner circumferential surface of the internal gear 39 and a respective one of the outer circumferences of the small diameter portion 14 and the end plate 37.

A plurality of sheave grooves 41 are formed in the outer circumference of the internal gear 39 in such a manner as to extend continuously in the circumferential direction, and main ropes, which are not shown, are wound around these sheaves. The main ropes are connected to the moving cage of the elevator at one ends and to counter weights at the other ends thereof. As a result, this internal gear is made integral with the sheave, and this eliminates the necessity of attaching the sheaves to the internal gear 39.

A number of internal teeth pins 42 constituting internal teeth of the internal gear are supported on the inner circumference of the internal gear 39 in a state in which they are disposed at the axially central portion of the internal gear 39 and inserted substantially half into the internal gear. These inner teeth pins 42 extend axially, and are spaced apart from each other at equal intervals in the circumferential direction. Reference numeral 43 denotes cylindrical roller followers which are provided in the same number as the number of the inner teeth pins 42, so that each of the followers 43 is rotatably fitted on and around the axially central portion of a respective one of the inner teeth pins 42.

Reference numeral 46 denotes a plurality of (three, in this embodiment) ring-like pinions disposed between the small diameter portion 14 and the end plate 37 and within the internal gear 39. Outer teeth 47 are formed in the outer circumference of each pinion 46 so that the number of the outer teeth 47 of the pinion 46 is slightly smaller than the number of the inner teeth pins 42. These outer teeth 47 of the pinions 46 are in mesh engagement with the inner teeth pins 42 of the internal gear 39 via the roller followers 43, and the phases of the mesh engaged states of the adjacent pinions 46 are shifted from each other by 180 degrees. Since the outer teeth 47 of the pinions 46 are brought into mesh engagement with the rotatable roller followers 43 of the inner teeth pins 42 in this manner, the mesh engagement between the inner teeth pins 42 and the outer teeth 47 is established as a rolling contact, thereby remarkably reducing and the frictional resistance, improving the transmission efficiency and reducing the rotational noise.

Reference numeral 50 denotes a pair of bearings interposed between the carrier 38 and the input shaft 21 loosely fitted in the central portion of the carrier 38, and with these bearing 50 the input shaft 21 is rotatably supported in the carrier 38. In addition, the input shaft 21 has, at its axially central portion between the bearings 50, three eccentric portions 51 which are made eccentric by an equal distance from the rotating axis, and the phases of adjacent two of the three eccentric portions 51 are shifted from each other by 180 degrees. These eccentric portions 51 are inserted respectively into the pinions 46 with roller bearings 52 therebetween.

When the input shaft 21 is driven to rotate by. the driving motor 23, the eccentric portions 51 rotate eccentrically, and the pinions 46 are caused to rotate eccentrically in a state that the phases of the adjacent pinions 46 are shifted from each other by 180 degrees (the pinions 46 rotate along the internal gear). Concurrently, since the number of the inner teeth pins 42 is slightly different from the number of the outer teeth 47, the rotation of the input shaft 21 is speed-reduced largely by virtue of the eccentric rotation of the pinions 46 to be transmitted to the internal gear 39, whereby the internal gear 39 is driven to rotate at a low rotational speed to move the main ropes.

Reference 55 denotes crankshafts which are provided in the same number as the number of the pillar portions 15, and each of the crankshafts 55 is disposed between and space apart from the adjacent pillar portions 15 in the circumferential direction. The axial end of each crankshaft 55 are rotatably supported by the small diameter portion 14 and the end plate 37 via bearings 56, respectively. The same number (three, in this embodiment) of eccentric portions 57 as the number of the eccentric portions 51 on the input shaft 21 are formed on an axially central portion of each crankshaft 55. These eccentric portions 57 are inserted in the pinions 46 with roller bearings 58 interposed therebetween, respectively. With this arrangement, the pinions 46 are supported on the carrier 38 in such a manner as to rotate eccentrically.

Reference numeral 59 denotes a cover attached to one end of the end plate 37, and this cover 59 closes an opened one end of a through hole of the carrier 38, through which the input shaft 21 is loosely fitted in. One side surface of this cover 59 is positioned on the same plane as the exposed one side surface of the end plate 37 so as to define a flat end face of the speed reducer 20 similarly to the opposite end face of the speed reducer 20. Since the both end faces of the speed reducer 20 are made flat, the driving motor 23 and the brake system 27 can be mounted on either of the end faces of the speed reducer 20, resulting in increase in degree of freedom in layout, and making it possible to provide various layouts.

The aforesaid input shaft 21, carrier 38, internal gear 39, pinions 46, crankshafts 55 and cover 59 cooperatively constitute the speed reducer 20 for speed-reducing and outputting the rotation of the driving motor 23 to the sheave (the internal gear 39). Since the speed reducer 20 is constructed as a center crank system in this manner, the speed reducer 20 and the driving motor 23 can easily be disposed coaxially.

Reference numeral 61 denotes a seal member interposed between the outer circumference of the other end of the input shaft 21 and the inner circumference of the other end of the carrier 38, and reference numerals 62, 63 denote, respectively, seal members interposed between the outer circumference of the other end of the internal gear 39 and the inner circumference of the other end of the carrier 38 (the inner circumference of the large diameter portion 13), and between the inner circumference of the one end of the internal gear 39 and the outer circumference of the other end of the carrier 38 (the outer circumference of the end plate 37). All of the openings of the speed reducer 20 are closed with these seal members so that the interior of the speed reducer 20 is tightly closed. In a case where the interior of the speed reducer 20 is closed with the seal members 61, 62, 63 as described above, no other seal member needs to be disposed between the speed reducer 20, the driving motor 23 and the brake system 27 when the speed reducer 20 is assembled to the driving motor 23 and the brake system 27. This facilitating the aforementioned assembly work.

Reference numeral 66 denotes an encoder functioning as a detector, disposed radially inwardly of the brake system 27 and fixed to the case 16, and a rotary portion of this encoder 66 is connected to the intermediate portion 26 for detection of the speed thereof to thereby detect the speed of the sheave (the internal gear 39). In a case where the encoder 66 is disposed radially inwardly of the brake system 27 as described above, even if a detector such as the encoder 66 is additionally provided on the hoisting device 11, the increase of the axial length of the hoisting device can be prevented.

Next, the operation of the first embodiment of the present invention will be described below.

In a case where the moving cage of the elevator is lifted up and/or down, the coil 18 of the driving motor 23 is excited and the permanent magnets 22 is caused to rotate together with the rotary body 19. Simultaneously with this, the electromagnet 35 of the brake system 27 is excited so as to attract the armatures 31*a, b,* whereby the braking plates 30*a, b* are released from the pressing force applied thereto by the springs 30*a, b,* the driving motor 23 being thus released from the brake applied thereto. As a result of this, the rotation of the rotary body 19 is transmitted to the input shaft 21 without being braked by the brake system 27, and the input shaft 27 is driven to rotate.

When the input shaft 21 rotates as described above, the pinions 46 rotate eccentrically (rotate along the internal gear 39), and since the number of inner teeth pins 42 slightly differs that of the outer teeth 47, the rotation of the input shaft 21 is largely speed-reduced by virtue of the eccentric rotations of the pinions 46 and transmitted to the internal gear 39, whereby the internal gear (sheave) 39 rotates at a low speed. Consequently, the main ropes wound around the sheave grooves 41 are moved to elevate the cage up and/or down. Concurrently, the speed of the internal gear 39 is detected by the encoder 66, and the vertical position of the moving cage is controlled.

Next, in a case where the lifting up and/or down of the moving case is stopped, the excitation to the coil 18 is interrupted to stop the driving of the driving motor 23, while the excitation to the electromagnet 35 is also interrupted to stop the attraction of the armatures 31*a, b* by the electromagnet 35, whereby the braking plates 30*a, b* and the armatures 31*a, b* are moved toward the stationary walls 29*a, b* until they are pressed against the stationary walls 29*a, b* by virtue of the biasing force of the springs 34*a, b.* As a result, the rotation of the braking plates 30*a, b* is restricted due to the frictional resistance between the braking plates 30*a, b* and the stationary walls 29*a, b,* and thus the braking force is applied to the driving motor 23 to stop the moving cage.

Figure 2:
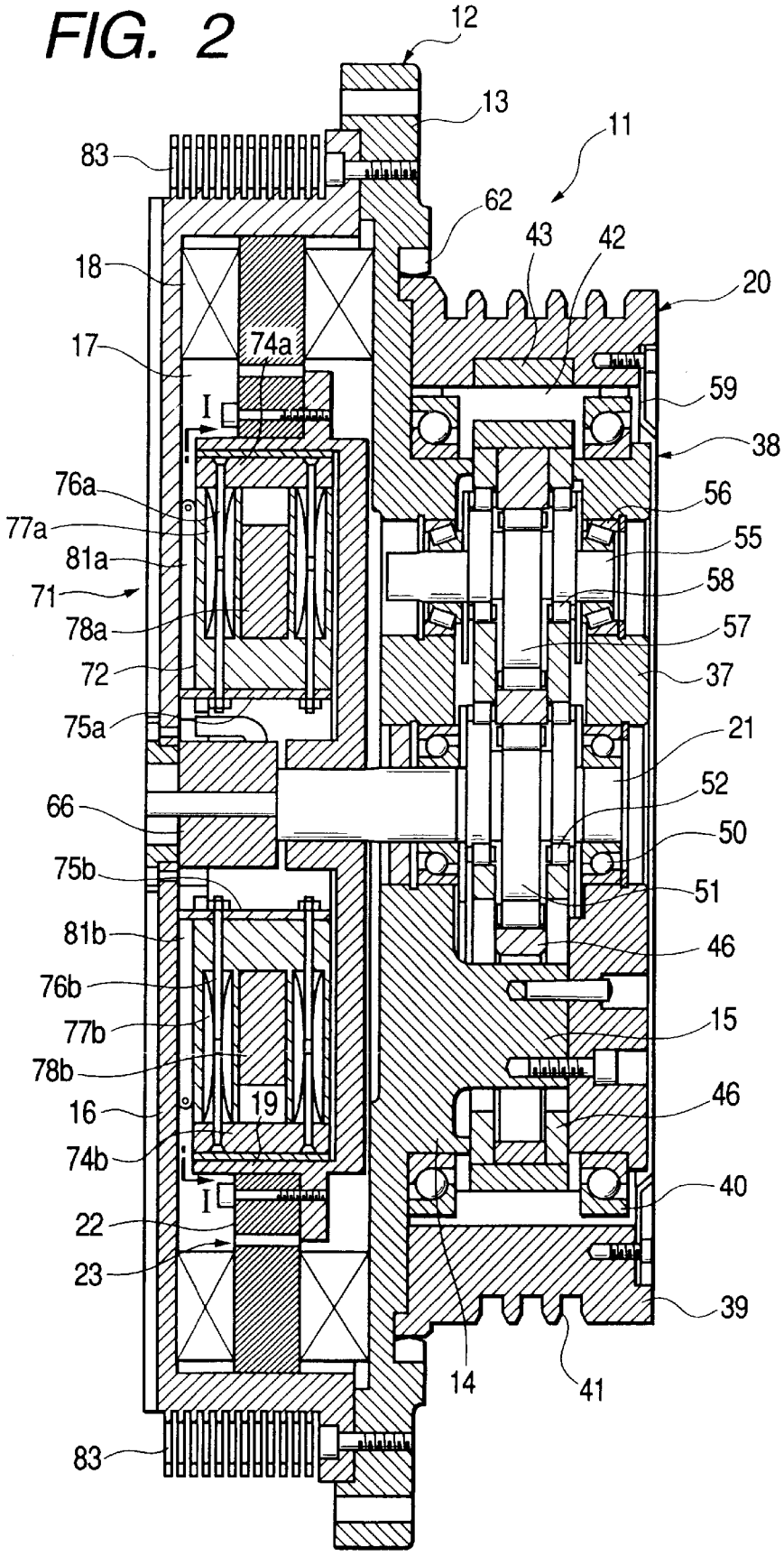
FIG. 2 is a front cross-sectional view showing a second embodiment of the invention.
Figure 3:
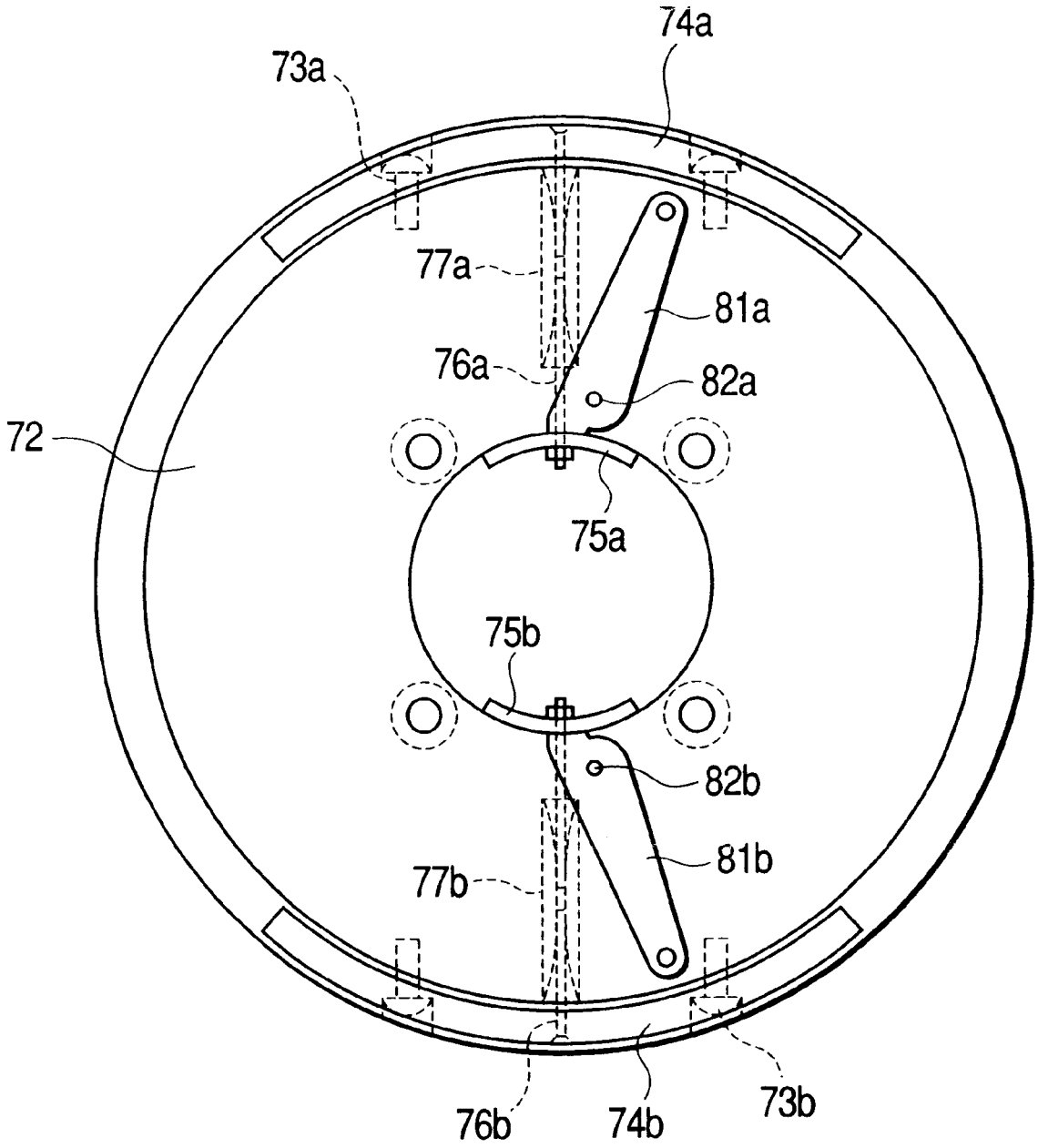
FIG. 3 is a view as seen in a direction indicated by arrows I—I in FIG. 2.

FIGS. 2 and 3 show a second embodiment of the invention. In the drawings, reference numeral 71 denotes a brake system accommodated radially inwardly of the driving motor 23. This brake system 71 applies a braking force to the rotary body 19 and permanent magnets 22 (i.e., to a rotary portion of the driving motor 23). The brake system 71 has a ring-like stationary member 72 fixed to the case 16, and a plurality of guide screws 73*a, b* are screwed into the outer circumference of this stationary member 72 for fixation.

Reference 74*a, b* denote a pair of shoes (a pair of arcuate shoes in this embodiment) spaced apart by 180 degrees. These shoes 74*a, b* are disposed radially outwardly of the stationary member 72, and the guide screws 73*a, b* are slidably inserted into the shoes. Consequently, these shoes 74*a, b* are supported radially movably through the guide screws 73*a, b* to the stationary member 72.

Reference 75*a, b* denote a pair of arcuate plates that can be brought into abutment with the inner circumference of the stationary member 72. These arcuate plates 75*a, b* are respectively connected to the shoes 74*a, b* by a pair of connecting rods 76*a, b* which radially penetrate through the stationary member 72. Reference 77*a, b* denote a pair of springs accommodated in the stationary member 72 to surround the respective connecting rods 76*a, b*. These springs 77*a, b* impart a radially outward biasing force to the shoes 74*a, b* to press the shoes 74*a, b* against the rotary body 19 and permanent magnets 22 (i.e., the rotary portion of the driving motor 23), to thereby apply the braking force to the rotary body 19 and the permanent magnets 22.

If a braking force is applied to the rotary body 19 by causing the two brake operating portions having respective shoes 74*a, b* to press against the rotary body 19, the braking force can be applied to the driving motor 23 at two positions. Accordingly, not only does the braking force become double but also even if one of the two brake operating portions fails to function, the remaining brake operating portion can still apply the brake force. Since the brake system 71, i.e. the single brake device, is provided with the two brake operating portions therein, not only can the safety be improved but also the hoisting device can be miniaturized.

Reference numeral 78*a, b* denote a pair of electromagnets accommodated, respectively, between the springs 77*a* and between the springs 77*b* in the stationary member 72, and when these electromagnets 78*a, b* are excited, the shoes 74*a, b* are attracted and are moved radially inwardly against the springs 77*a, b*. Consequently, the shoes 74*a, b* moves away from the rotary body 19, and the rotary portion of the driving motor 23 is released from being braked. The aforesaid stationary member 72, guide screws 73*a, b*, shoes 74, *b*, arc-like plates 75*a, b*, connecting rods 76*a, b*, springs 77*a*, band electromagnets 78*a, b* cooperatively constitute the brake system 71 of a drum type. With this construction, the rotary body 19 to which the braking force is applied by the shoes 74*a, b* can be used commonly as the rotary portion of the driving motor 23 (normally, a separate brake drum is additionally required). Accordingly, the hoisting device 11 can be made simple in construction and be miniaturized.

Reference numerals 81*a, b* denote a pair of release levers extending substantially radially, which are rotatably supported to the stationary member 72 via pins 82*a, b* at radially inner end portions thereof. The outer circumferences of the arcuate plates 75*a, b* are in engagement with the radially inner ends of the release levers 81*a, b*, while wires, not shown, are connected to radially outer ends of the release levers 81*a, b*.

In a case where the brake applied to the driving motor 23. is manually released when there occurs a trouble in which the excitation to the electromagnets 78*a, b* cannot be controlled, the wires are pulled to cause the release levers 81*a, b* to swing to erect, so that the arcuate plates 75*a, b*, connecting rods 76*a, b*, and shoes 74*a, b* are moved together radially inwardly against the springs 77*a, b*. Reference numeral 83 denotes a cooling fin fixed to the outer circumference of the case 16. The remaining construction of the second embodiment is identical to that of the first embodiment.

Note that while the cylindrical roller followers 43 are fitted on the outer sides of the inner teeth pins 42 in the embodiments described above, the present invention should not be restricted thereto or thereby, and for example, cylindrical bearings may be fitted on the outer sides of the inner teeth pins. Further, in the embodiments described above, while the crankshafts 55 having the eccentric portions 57 are inserted into the pinions 46, the present invention should not be restricted thereto or thereby, and for example, circular pillar-like pins may be inserted into the pinions. Furthermore, while the eccentric oscillating reduction gear 20 is used in the embodiments described above, any type of speed reducer may be used in the present invention.

As has been described heretofore, according to this invention, the hoisting device for an elevator can be thinned by reducing the axial length of the device.

What is claimed is:

1. A hoisting device for an elevator comprising:

a cylindrical driving motor;

a brake system, accommodated radially inwardly of said driving motor, for applying a braking force to a rotary portion of said driving motor; and a speed reducer, disposed on one side of said driving motor and said brake system, for speed-reducing and transmitting rotation of the driving motor to a sheave.

2. A hoisting device for an elevator as set forth in claim 1, wherein said brake system is formed into a cylindrical shape, and a detector for detecting rotational speed of said sheave is disposed radially inwardly of said brake system.

3. A hoisting device for an elevator as set forth in claim 1 or 2, wherein said brake system includes:

an annular stationary member, a shoe radially movably supported on said stationary member, and a press portion for imparting a radially outward biasing force to said shoe, wherein said shoe is adapted to be pressed against an inner circumferential surface of said rotary portion of said driving motor.

4. A hoisting device for an elevator as set forth in claim 1 or 2, wherein said speed reducer is constituted as an eccentric oscillating speed reducer including:

a plurality of pinions, a carrier supporting said pinions, an input shaft for rotating said pinions eccentrically, and an internal gear in mesh engagement with said pinions, wherein said internal gear of said eccentric oscillating speed reducer is integrally provided with said sheave as a unitary body.

5. A hoisting device for an elevator as set forth in claim 4, wherein seal members are provided between said input shaft and said carrier and between said carrier and said internal gear to sealingly close an interior of said speed reducer.

6. A hoisting device for an elevator as set forth in claim 1, wherein said brake system having therein a plurality of brake operating portions that can apply brake force to said rotary portion of said driving motor independently one from another.

7. A hoisting device for an elevator as set forth in claim 1, wherein said speed reducer has a stationary member rotatably supporting said sheave, and a cup-shaped case is fixed to said stationary member to define a closed space accommodating said driving motor and said brake system therein.

* * * * *

UNITED STATES PATENT AND TRADEMARK OFFICE

CERTIFICATE OF CORRECTION

PATENT NO. : 6,520,483 B1 
DATED : February 18, 2003
INVENTOR(S) : Hiroyuki Miyoshi and Takashi Kuga It is certified that error appears in the above-identified patent and that said Letters Patent is hereby corrected as shown below:

Title page,
Item [73], Assignee, replace "Seiko" with -- Seiki --.

Signed and Sealed this

Twelfth Day of August, 2003

JAMES E. ROGAN
*Director of the United States Patent and Trademark Office*